US005224657A

United States Patent [19]

Kuriyama et al.

[11] Patent Number: 5,224,657

[45] Date of Patent: Jul. 6, 1993

[54] CRYOGENIC REFRIGERATOR

[75] Inventors: Toru Kuriyama, Yokohama; Hideki Nakagome, Tokyo; Yoichi Tokai, Yokohama, all of Japan

[73] Assignee: Kabushiki Kaisha Toshiba, Kawasaki, Japan

[21] Appl. No.: 776,885

[22] Filed: Oct. 17, 1991

Related U.S. Application Data

[63] Continuation-in-part of Ser. No. 526,662, May 22, 1990, abandoned.

[30] Foreign Application Priority Data

| | | | |
|---|---|---|---|
| May 23, 1989 | [JP] | Japan | 1-127771 |
| May 23, 1989 | [JP] | Japan | 1-127772 |
| Oct. 13, 1989 | [JP] | Japan | 1-265158 |
| Oct. 13, 1989 | [JP] | Japan | 1-265159 |
| Nov. 17, 1989 | [JP] | Japan | 1-297578 |

[51] Int. Cl.[5] ..... B02C 17/00

[52] U.S. Cl. ..... 241/24; 51/313

[58] Field of Search ..... 51/313, 163.1; 241/24, 241/25

[56] References Cited

U.S. PATENT DOCUMENTS

| | | | |
|---|---|---|---|
| 2,591,083 | 4/1952 | Maier | 51/163.1 X |
| 4,221,342 | 9/1980 | Tadema et al. | 241/79 |
| 4,366,676 | 1/1983 | Wheatley et al. . | |
| 4,825,660 | 5/1989 | Okumura . | |

FOREIGN PATENT DOCUMENTS

| | | | |
|---|---|---|---|
| 650685 | 10/1962 | Canada | 51/313 |
| 2000669 | 9/1969 | France . | |
| 536182 | 5/1941 | United Kingdom | 51/313 |
| 1168814 | 10/1969 | United Kingdom . | |

OTHER PUBLICATIONS

"A New Low-Temperature Gas Expansion Cycle", Part 1 by McMahon and Gifford, W. E., Advances in Cryogenic Eng. vol. 5, pp. 354-367, (1960).

"The Gifford-McMahon Cycle", by Gifford, W. E., Advances in Cryogenic Eng., vol. II, pp. 152-159, (1966).

*Primary Examiner*—Mark Rosenbaum

*Assistant Examiner*—John M. Husar

*Attorney, Agent, or Firm*—Oblon, Spivak, McClelland, Maier & Neustadt

[57] ABSTRACT

A cryogenic refrigerator comprising a closed cylinder provided with an inlet and an outlet for introducing and discharging a coolant gas into and out of the cylinder, a displacer slidably housed in the closed cylinder and housing a cooling member therein and having a passage through which the coolant gas flows, a device coaxially arranged in and along the passage of the displacer in which the cooling member is housed to divide the passage into outer and inner ones, a device for reciprocating the displacer in the cylinder, and a device for repeating the process of introducing the high pressure coolant gas into the cylinder through the inlet and discharging it out of the cylinder, synchronizing with the reciprocating displacer.

11 Claims, 16 Drawing Sheets

CRYOGENIC REFRIGERATOR

This application is a continuation-in-part of application Ser. No. 07/526,662, filed on May 22, 1990, now abandoned.

BACKGROUND OF THE INVENTION

1. Field of the Invention

The present invention relates to a cryogenic refrigerator and, more particularly, a refrigerator of the refrigerant-accumulating type.

2. Description of the Related Art

Various kinds of cryogenic refrigerators are now on the market. One of them is of the Gifford-McMahon type. This refrigerator is usually arranged as shown in FIG. 1.

The refrigerator comprises generally a cold head 1 and a coolant gas introducing and discharging system 2. The cold head 1 includes a closed cylinder 11, a displacer 12 freely reciprocating in the cylinder 11, and a motor 13 for driving the displacer 11.

The cylinder 11 includes a first large-diameter cylinder 14 and a second small-diameter cylinder 15 coaxially connected to the first cylinder 14. The border wall between the first 14 and the second cylinder 15 forms a first stage 16 as a cooling face and the front wall of the cylinder 15 forms a second stage 17 which is lower in temperature than the first stage 16. The displacer 12 includes a first displacer 18 reciprocating in the first cylinder 14 and a second displacer 19 reciprocating in the second cylinder 15. The first and second displacers 18 and 19 are connected to each other in the axial direction of the cylinder 11 by a connector 20. A fluid passage 21 is formed in the first displacer 18, extending in the axial direction of the displacer 18, and a cooling member 22 formed of copper meshes or the like is housed in the fluid passage 21. Similarly, a fluid passage 23 is formed in the second displacer 19, extending in the axial direction of the displacer 19, and a cooling member 24 formed of lead balls or the like is formed in the fluid passage 23. Seal systems 25 and 26 are located between the outer circumference of the first displacer 18 and the inner circumference of the first cylinder 14 and between the outer circumference of the second displacer 19 and the inner circumference of the second cylinder 15, respectively.

The top of the first displacer 18 is connected to the rotating shaft of the motor 13 through a connector rod 31 and a Scotch yoke or crankshaft 32. When the shaft of the motor 13 is rotated, therefore, the displacer 12 reciprocates, as shown by an arrow 33 in FIG. 1, synchronized with the rotating shaft of the motor 13.

An inlet 34 and an outlet 35 for introducing and discharging coolant gas extend from the upper portion of one side of the first cylinder 14 and are connected to the coolant gas introducing and discharging system 2. The coolant gas introducing and discharging system 2 serves as a helium gas circulating system, comprising connecting the outlet 35 to the inlet 34 through a low-pressure valve 36, a compressor 37 and a high-pressure valve 38. Namely, this system 2 is intended to compress low-pressure (about 5 atm) helium to high-pressure (about 18 atm) helium by the compressor 37 and send it into the cylinder 11. The low- and high-pressure valves 36 and 38 are opened and closed, as will be described later, in a relation to the reciprocation of the displacer 12.

The portions in the refrigerator where cooling is effected or which act as cooling faces are the first and second stages 16 and 17, which are cooled or refrigerated to about 30 K. and 10 K., respectively, when no thermal load is present. Therefore, a temperature gradient ranging from a normal temperature (300 K.) to 30 K. exists between the top and bottom of the first displacer 18 and a temperature gradient ranging from 30 K. to 10 K. exists between the top and bottom of the second displacer 19. These temperature gradients, however, are changed by thermal loads at the step stages and it usually ranges from 30 K. to 80 K. at the first stage 16 while it ranges from 10 K. to 20 K. at the second stage 17.

When the motor 13 starts its rotation, the displacer 12 reciprocates between top and bottom dead centers. When the displacer 12 is at the bottom dead center, the high-pressure valve 38 is opened, allowing high-pressure helium gas to flow into the cold head 1. The displacer 12 then moves to the top dead center. As described above, the seal systems 25 and 26 are arranged between the outer circumference of the first displacer 18 and the inner circumference of the first cylinder 14 and between the outer circumference of the second displacer 19 and the inner circumference of the second cylinder 15, respectively. When the displacer 12 moves to the top dead center, therefore, high-pressure helium gas flows into a first stage expansion chamber 39 formed between the first 18 and the second displacer 19 and then into a second stage expansion chamber 40 formed between the second displacer 19 and the front wall of the second cylinder, passing through the fluid passage 21 in the first displacer 18 and the fluid passage 23 in the second displacer 19. While flowing in this manner, high-pressure helium gas is cooled or refrigerated by the cooling members 22 and 24, so that high-pressure helium gas flowing into the first stage expansion chamber 39 can be cooled to about 30 K. and high-pressure helium gas flowing into the second stage expansion chamber 40 can be cooled to about 8 K. Here, the high-pressure valve 38 is closed and the low-pressure valve 36 is opened. When the low-pressure valve 36 is opened, high-pressure helium gas in the first stage expansion chamber 39 and the second stage expansion chamber 40 is expanded and cooling is effected. The first stage 16 and the second stage 17 are cooled by this cooling phenomenon. Then, the displacer 12 moves to the bottom dead center again and helium gas in the first stage expansion chamber 39 and the second stage expansion chamber 40 is removed as the movement of the displacer 12. The expanded helium gas is warmed by the cooling members 22 and 24 while passing through the fluid passages 21 and 23, and is at an ordinary temperature and discharged. Thereafter, the above-mentioned cycle is repeated and the refrigerating operation is performed. This type of the refrigerator is used for cooling a superconducting magnet or an infrared sensor, or as a cooling source of a cryopump.

However, the above-structured conventional cryogenic refrigerators have the following problems. Specifically, the cylindrical fluid passage 23 is formed in the second displacer 19 and the inside of the passage is filled with the ball or grain-like cooling member 24. Speed distribution in helium gas flowing through the passages which were filled with balls or grains was measured and it was found that velocity of flow was the lowest in the center of the flow of helium gas and that it became higher and higher moving away from the center of the flow of helium gas outward in the radial direction thereof. This means that a larger amount of helium gas flows only into some area of the cooling member 24 and that the cooling member 24 must exchange heat with excessive helium gas at this area thereof when heat exchange is to be done between helium gas and the cooling member 24. This teaches us that the cooling member 24 is not efficiently used. Therefore, cooling efficiency (or heat exchanging efficiency achieved by a cooling means) is reduced at the area of the cooling member, thereby resulting in reducing refrigerating capacity at a certain temperature.

The conventional refrigerators arranged as shown in FIG. 1 have a problem as described below. The seal system 25 prevents helium gas from flowing from the normal temperature section to the first expansion chamber 39 and vice versa, passing through a clearance between the first cylinder 14 and the first displacer 18, while the seal system 26 prevents helium gas from flowing from the first stage expansion chamber 39 to the second stage expansion chamber 40 and vice versa, passing through a clearance between the second cylinder 15 and the second displacer 19. These seal systems 25 and 26 are used in helium gas of high purity (99.99%) and a lubricating material such as grease cannot be used in them because it contaminates helium gas. Particularly the seal system 26 is located at the low temperature section (30 to 80 K.) and has a shape like the piston seal. Providing that the first stage expansion chamber 39 has a temperature of 30 K. while the second stage expansion chamber 40 has a temperature of 10 K. and that helium gas leaks at some portion of the seal system 26, helium gas of 30 K. will enter into the second stage expansion chamber 40 without contacting the cooling member 24 in the second displacer 19 and helium gas of 10 K. will enter into the first stage expansion chamber 39. As the result, the temperature of the first stage 16 falls and that of the second stage 17 rises. FIG. 3 shows, as results calculated, the relation between the ratio of the amount of helium gas leaked through the seal system 26 (or ratio of the amount of helium gas flowing into the second stage expansion chamber 40 through the seal system 26 relative to the total amount of helium gas flowing into the chamber 40 through the passage) and the temperature of each of the first and second stages 16, 17. As apparent from FIG. 3, helium gas leaked at some portion of the seal system 26 adds large influence to the temperature of each of the stages 16 and 17. Same thing can also be said about the seal system 25.

In the conventional refrigerators, the seal system 26 used comprises fitting a turn of sealing 28 provided with overlapped ends 30 as shown in FIG. 6 into a ring-shaped groove 27 on the outer circumference of the second displacer 19 and arranging a spring ring 29 on the backside of the sealing 28 to urge the sealing 28 against the second cylinder 15, as shown in FIGS. 4 through 6. In the case of the seal system 26 having the above-described arrangement, a considerable amount of helium gas is allowed to leak through the overlapped ends 30 of the sealing 28, thereby causing the temperature of the second stage 17 to rise. This results in reducing refrigerating capacity at a certain temperature.

Providing that the temperature of the first stage expansion chamber 39 is 30 K. while that of the second stage expansion chamber 40 is 10 K. and that helium gas leaks through the sealing portion, helium gas of 30 K. will enter into the second stage expansion chamber 40 while helium gas of 10 K. into the first stage expansion chamber 39, without fully contacting the cooling member 24 in the second displacer 19. As a result, the temperature of the first stage 16 lowers while that of the second stage 17 rises. FIG. 7 shows, as results calculated, what relation exists between the ratio of the amount of helium gas leaking through the clearances (or ratio of the amount of helium gas flowing into the second stage expansion chamber 40 through the sealing portion relative to the total amount of helium gas flowing into the chamber 40 through the cooling member) and the temperature of each of the first and second stages 16 and 17. As apparent from FIG. 7, helium gas leaking through the sealing portion between the displacer and the cooling member adds large influence to the temperature of each of the stages.

The conventional refrigerators arranged as shown in FIG. 1 have another problem as described below. When magnetic material is used as a part or whole of the cooling member 24 in the second displacer 19, it is quite difficult to process the magnetic material into balls or meshes such as the cooling member 22 in the first displacer 18. The magnetic material is therefore melted to a bulky mass, which is ground and screened to grains each having a size of about 100 to 500 μm. These grains substantially same in size are used as the cooling member. However, each of these grains has sharp edges and tips which are several μm in size, and these sharp edges and tips are broken off the grains while the refrigerator is under operation. The cooling member 24 is covered by sheets of net at the top and bottom thereof not to drop from the second displacer 19, but these sheets of net have meshes each having a size of several tens μm and fine edges and tips broken off the grains of magnetic material pass through these meshes of the nets together with helium gas. When the meshes of the nets which cover the top and bottom of the cooling member 24 are made smaller in size, however, the pressure loss of helium gas is increased. This is not a merit. The fine edges and tips of magnetic material dropped from the second displacer 19 adhere to the seal 25 to thereby increase the amount of helium gas which leaks through the seal 25. This lowers the refrigerating capacity of the refrigerator to a great extent. In addition, the fine edges and tips of magnetic material dropped come to the compressor 37, passing through the first displacer 18 and the valve 36. As the result, the valve 36 can be blocked and the compressor 37 can be damaged by them. When ground grains of magnetic material are used as the cooling member as described above, the capacity of the refrigerator is lowered and the refrigerator itself is damaged.

The conventional refrigerators arranged as shown in FIG. 1 have a further problem as described below. When the first and second displacers 18 and 19 are filled with the cooling members 22 and 24, clearances are caused between the cooling members and the displacers. When gas flows passing through these clearances, effective heat exchange cannot be carried out between the gas and the cooling member.

SUMMARY OF THE INVENTION

An object of the present invention is to provide a cryogenic refrigerator capable of causing coolant gas to uniformly flow through a cooling member to increase the refrigerating capacity of the refrigerator.

Another object of the present invention is to provide a cryogenic refrigerator capable of enhancing sealing performance between a cylinder and a displacer to increase the refrigerating capacity of the refrigerator.

A further object of the present invention is to provide a cryogenic refrigerator capable of preventing the cooling member from creating fine powder to increase the refrigerating capacity of the refrigerator.

According to the present invention, there is provided a cryogenic refrigerator comprising a closed cylinder provided with an inlet and an outlet for introducing and discharging a coolant gas into and out of the cylinder; a displacer slidably housed in the closed cylinder and housing a cooling member therein and having a passage through which the coolant gas flows; a means coaxially arranged in and along the passage of the displacer in which the cooling member is housed to divide the passage into outer and inner ones; a means for reciprocating the displacer in the cylinder; and a means for repeating the process of introducing the high pressure coolant gas into the cylinder through the inlet and discharging it out of the cylinder, synchronized with the reciprocating displacer.

According to the present invention, there is provided a cryogenic refrigerator comprising a closed cylinder provided with an inlet and an outlet for introducing and discharging a coolant ga into and out of the cylinder; a displacer slidable arranged in the closed cylinder and housing a cooling member therein and having a passage through which the coolant gas flows; plural gas penetrating diaphragms arranged in the passage in which the cooling member is housed and separated from one another by a certain interval in a direction perpendicular to the direction in which the passage is directed; a means for reciprocating the displacer in the cylinder; a means for repeating the process of introducing the coolant ga into the cylinder through the inlet and discharging it out of the cylinder through the outlet in a relation to the reciprocating displacer.

According to the present invention, a cryogenic refrigerator can be provided comprising a closed cylinder provided with an inlet and an outlet for introducing and discharging a coolant gas into and out of the cylinder; a displacer slidably arranged in the closed cylinder and housing a cooling member therein and having a passage through which the coolant gas flows; plural gas penetrating diaphragms arranged in the passage in which the cooling member is housed and separated from one another by a certain interval in a direction perpendicular to the direction in which the passage is directed; a means for reciprocating the displacer in the cylinder; a means for repeating the process of introducing the high pressure coolant gas into the cylinder through the inlet and discharging it out of the cylinder through the outlet in a relation to the reciprocating displacer and first and second sealing members arranged along the axis of the displacer to seal the clearance between the closed cylinder and the displacer; wherein said displacer has two ring-shaped grooves on the outer circumference thereof and each of the sealing members includes two sealing rings each having both ends and piled one upon the other in the ring-shaped groove in the axial direction of the displacer and a spring ring having both ends and located on the back side of these sealing rings.

According to the present invention, a cryogenic refrigerator can be provided comprising a closed cylinder provided with an inlet and an outlet for introducing and discharging a coolant gas into and out of the cylinder; a displacer slidably arranged in the closed cylinder and housing a cooling member therein and having a passage through which the coolant gas flows; a means for reciprocating the displacer; and a means for repeating the process of introducing the coolant gas into the cylinder through the inlet and discharging it out of the cylinder through the outlet in a relation to the reciprocating displacer; wherein said cooling member is those grains of a magnetic matter which are coated by a metal film.

According to the present invention, a cryogenic refrigerator can be provided comprising a closed cylinder provided with an inlet and an outlet for introducing and discharging a coolant gas into and out of the cylinder; a displacer slidably arranged in the closed cylinder and housing a cooling member therein and having a passage through which the coolant gas flows: a fibrous member arranged between the displacer and the cooling member; a means for reciprocating the displacer; and a means for repeating the process of introducing the high pressure coolant gas into the cylinder through the inlet and discharging it out of the cylinder through the outlet in a relation to the reciprocating displacer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

Figure 1:
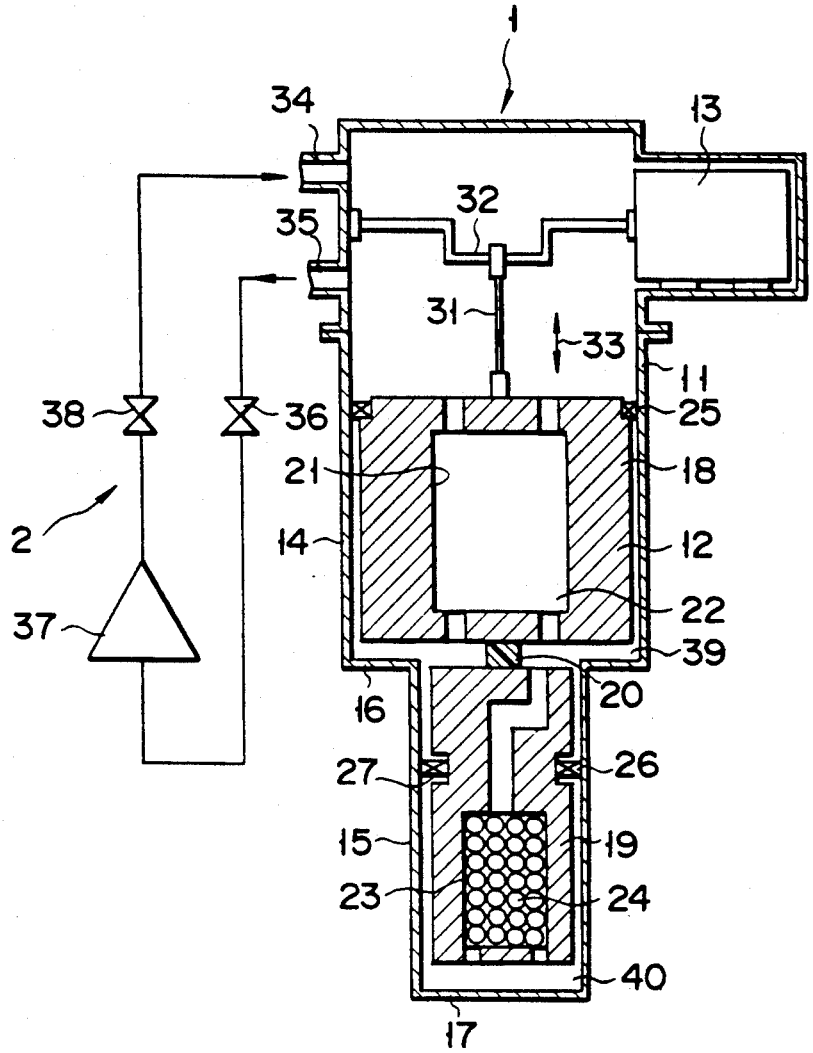
F I G. 1 (PRIOR ART)
FIG. 1 is a cross sectional view showing a conventional Gifford-McMahon type cryogenic refrigerator.
Figure 5:
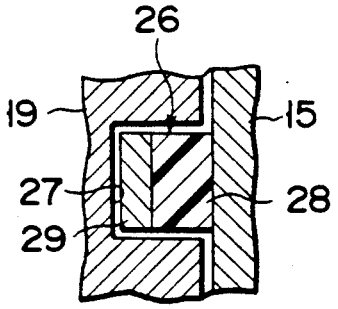
FIG. 5 (PRIOR ART)
Figure 6:
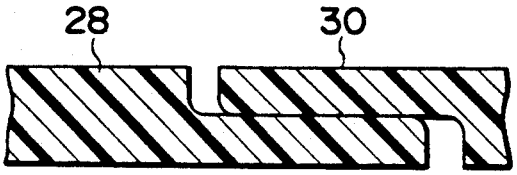
FIG. 6 (PRIOR ART)
Figure 7:
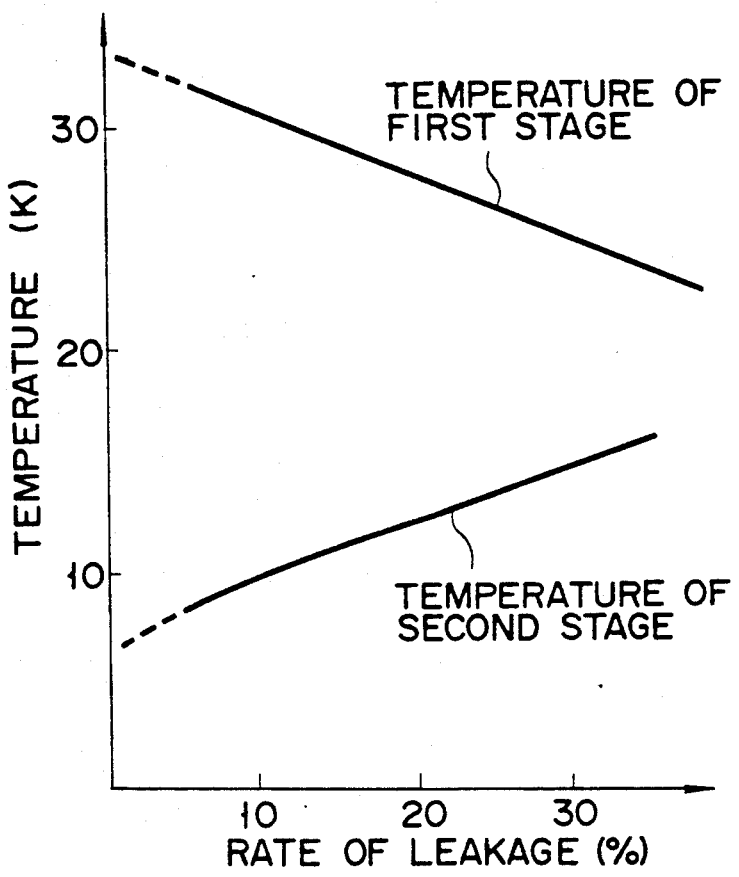
FIG. 7 is a graph showing the relationship of a rate of leakage and temperature of stages between a second displacer and a cooling member of the refrigerator of FIG. 1.
Figure 15:
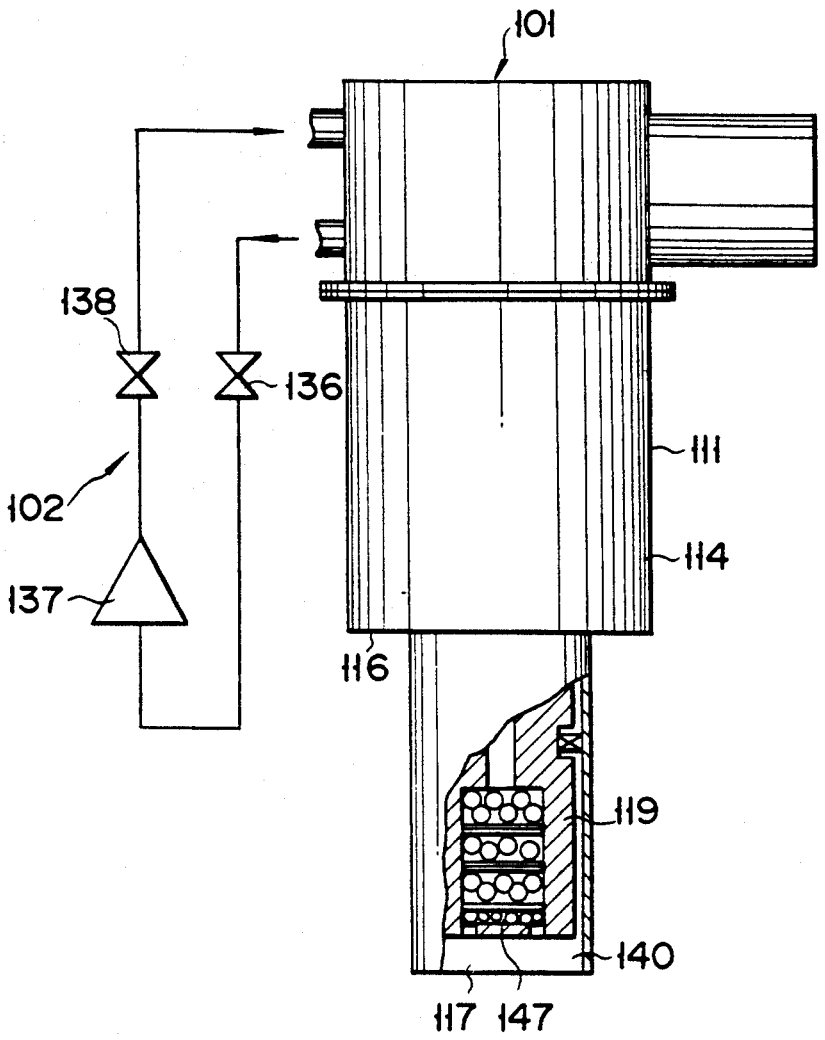
Figure 16:
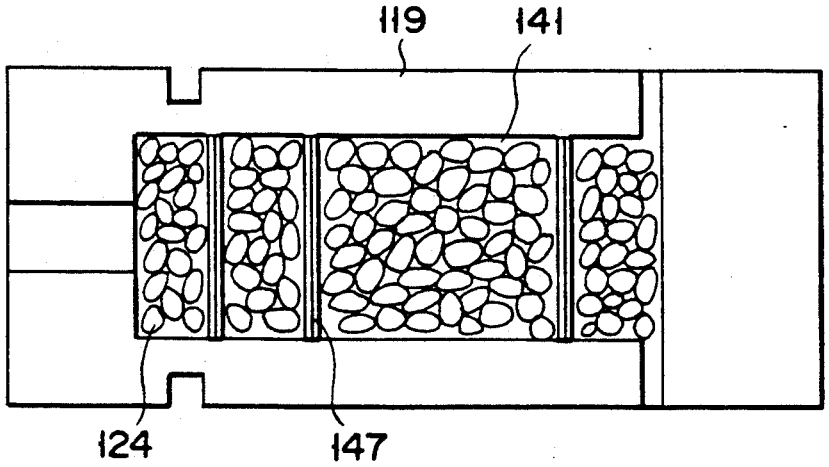
Figure 17:
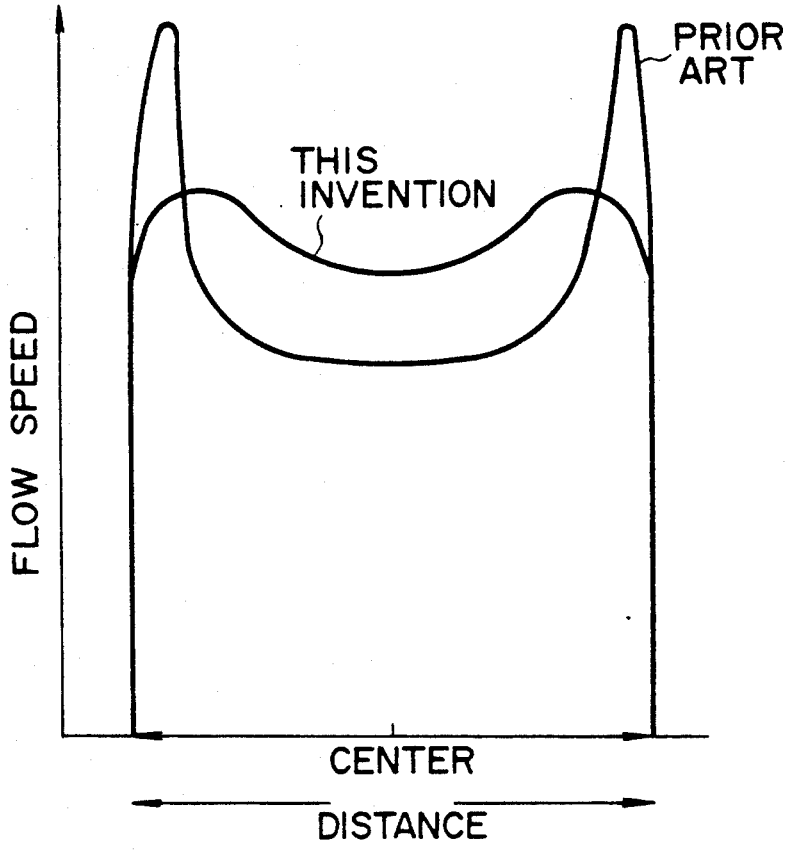
Figure 18:
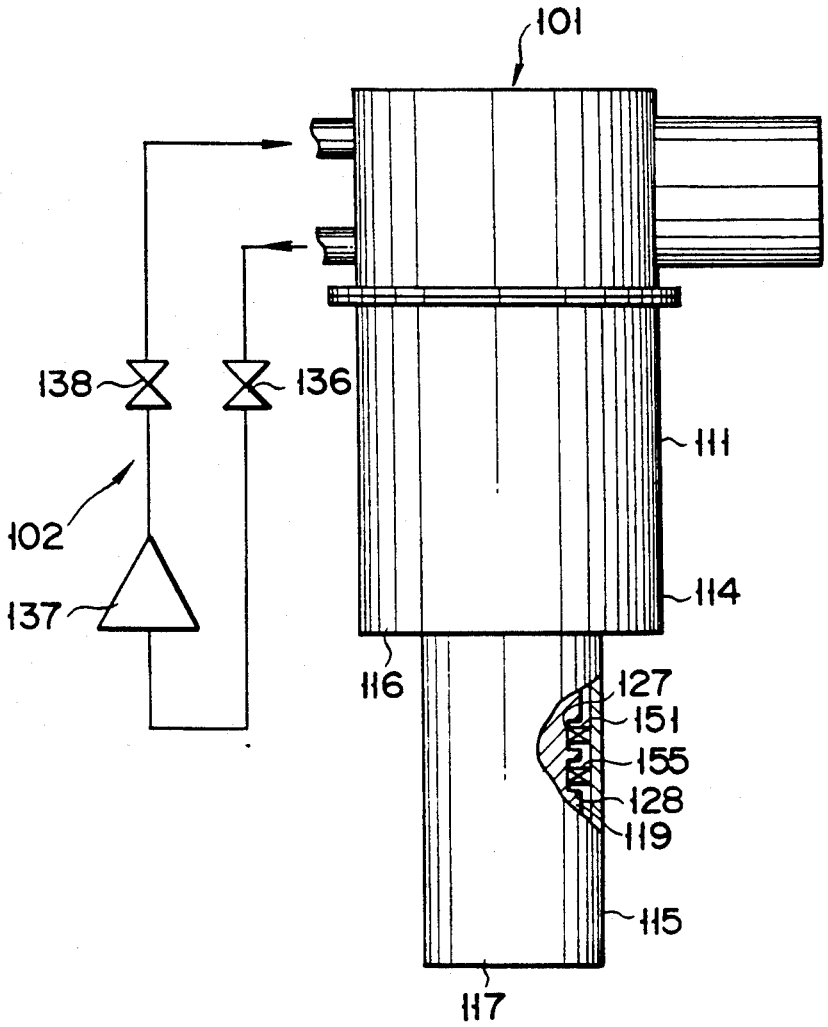
Figure 19:
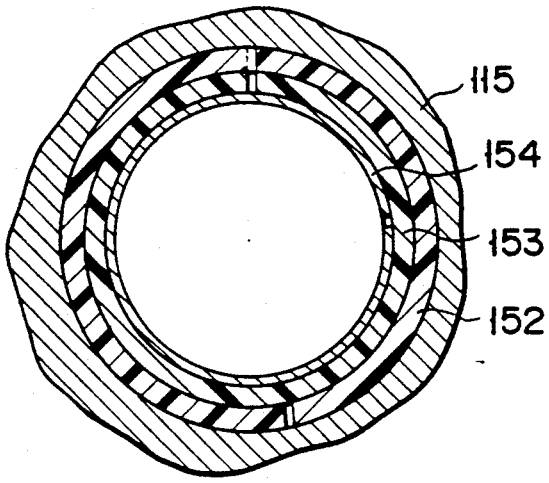
Figure 20:
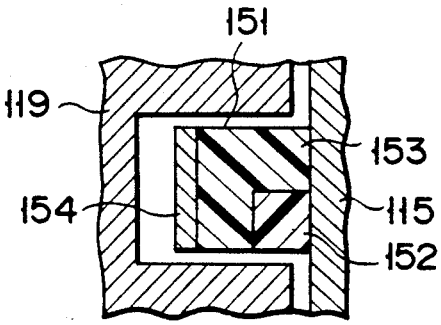
Figure 21:
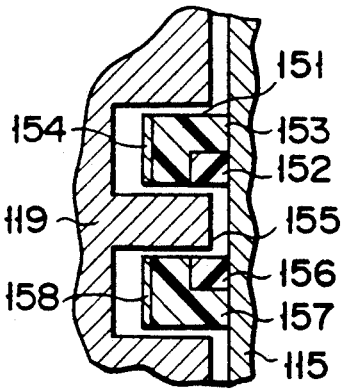
Figure 22:
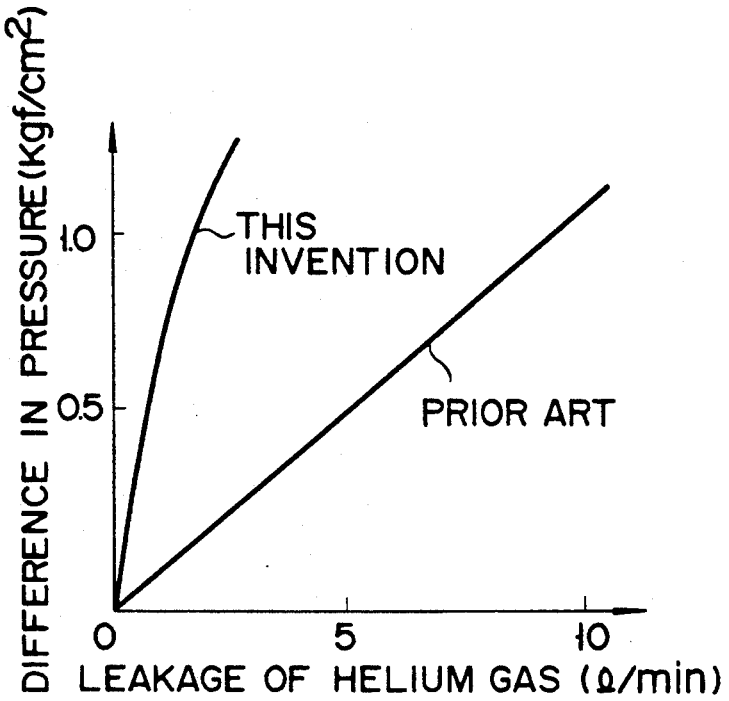
Figure 23:
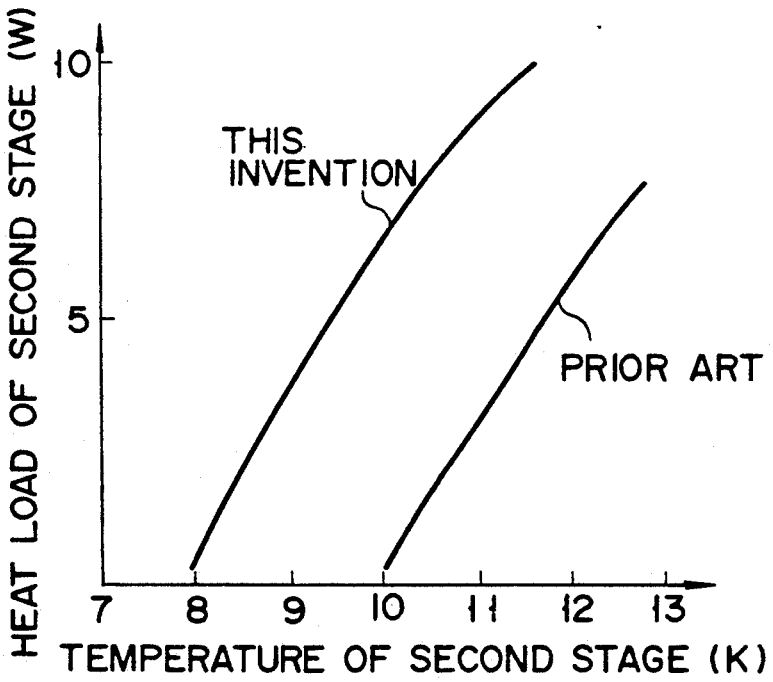
Figure 24:
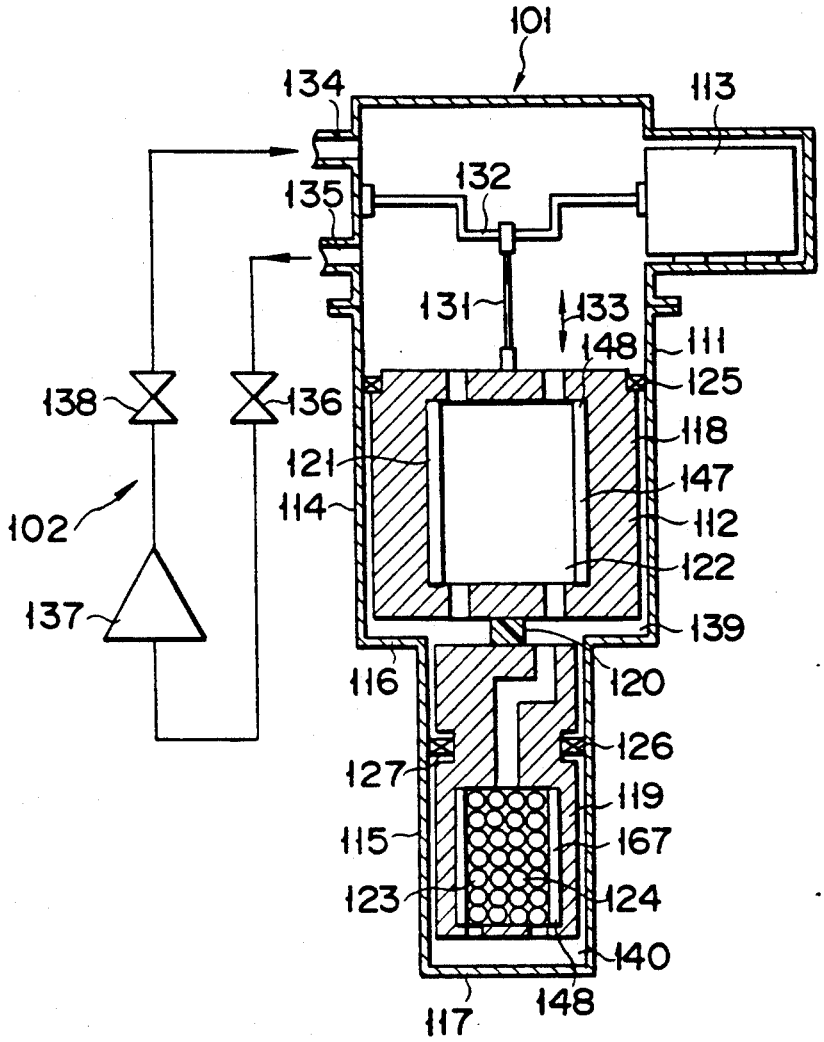
Figure 25:
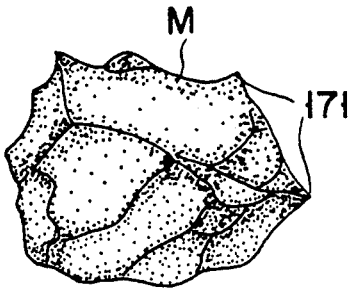
Figure 26A:
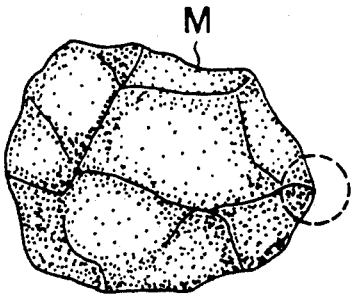
Figure 26B:
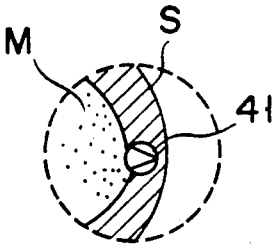
Figure 27:
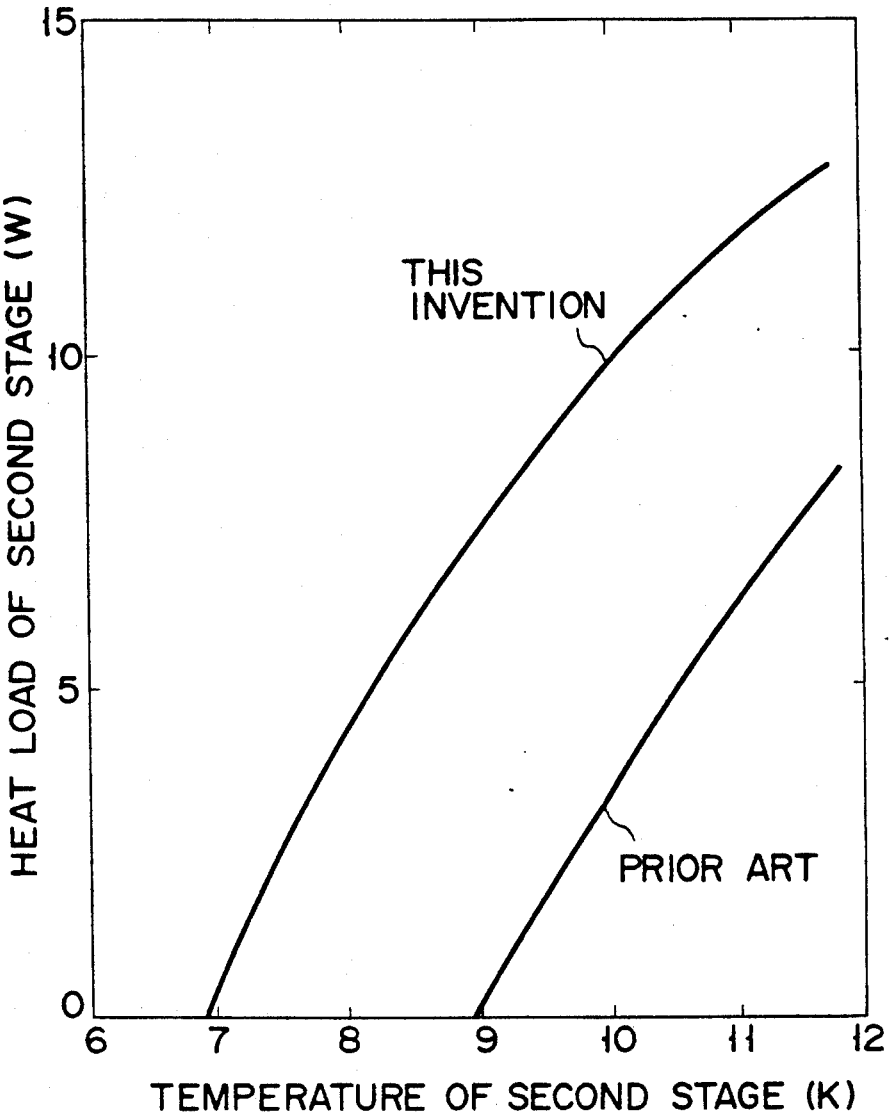
Figure 28:
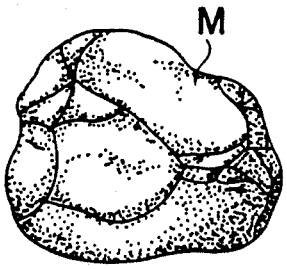

FIG. 15 is a cross sectional view showing a Gifford-McMahon type cryogenic refrigerator relating to a third embodiment of the present invention;

FIG. 16 is a cross sectional view showing a second displacer of the refrigerator of FIG. 15;

FIG. 17 is a graph showing the comparison between the speed distribution in helium gas in the cooling member of the second displacer of the refrigerator of FIG. 1 and that of the second displacer of the refrigerator of FIG. 15;

FIG. 18 is a cross sectional view showing a Gifford-McMahon type cryogenic refrigerator relating to a fourth embodiment of the present invention;

FIGS. 19 to 21 are cross sectional views showing a sealing mechanism of the refrigerator of FIG. 18;

FIG. 22 is a graph showing the relationship between leakage of helium and difference in pressure in the refrigerator, in which the sealing mechanism of FIG. 5 is incorporated, and the refrigerator, in which the sealing mechanism of FIG. 21 is incorporated;

FIG. 23 is a graph showing the cooling curves of the refrigerator, in which the sealing mechanism of FIG. 5 is incorporated, and the refrigerator, in which the sealing mechanism of FIG. 20 is incorporated;

FIG. 24 is a cross sectional view showing a Gifford-McMahon type cryogenic refrigerator relating to a fifth embodiment of the present invention;

FIG. 25 is a view showing a magnetic member using as a cooling member of the cryogenic refrigerator;

FIGS. 26A and 26B are views showing the state that the magnetic member of FIG. 25 is plated with metal;

FIG. 27 is a graph showing the cooling curves of the refrigerator in which the magnetic member of FIG. 25 is incorporated, and the refrigerator in which the magnetic member of FIGS. 26A and 26B is incorporated; and FIG. 28 is a view showing the magnetic member after mixing.

DETAILED DESCRIPTION OF THE PREFERRED EMBODIMENTS

Some preferred embodiments of the present invention will be described in detail.

Figure 8:
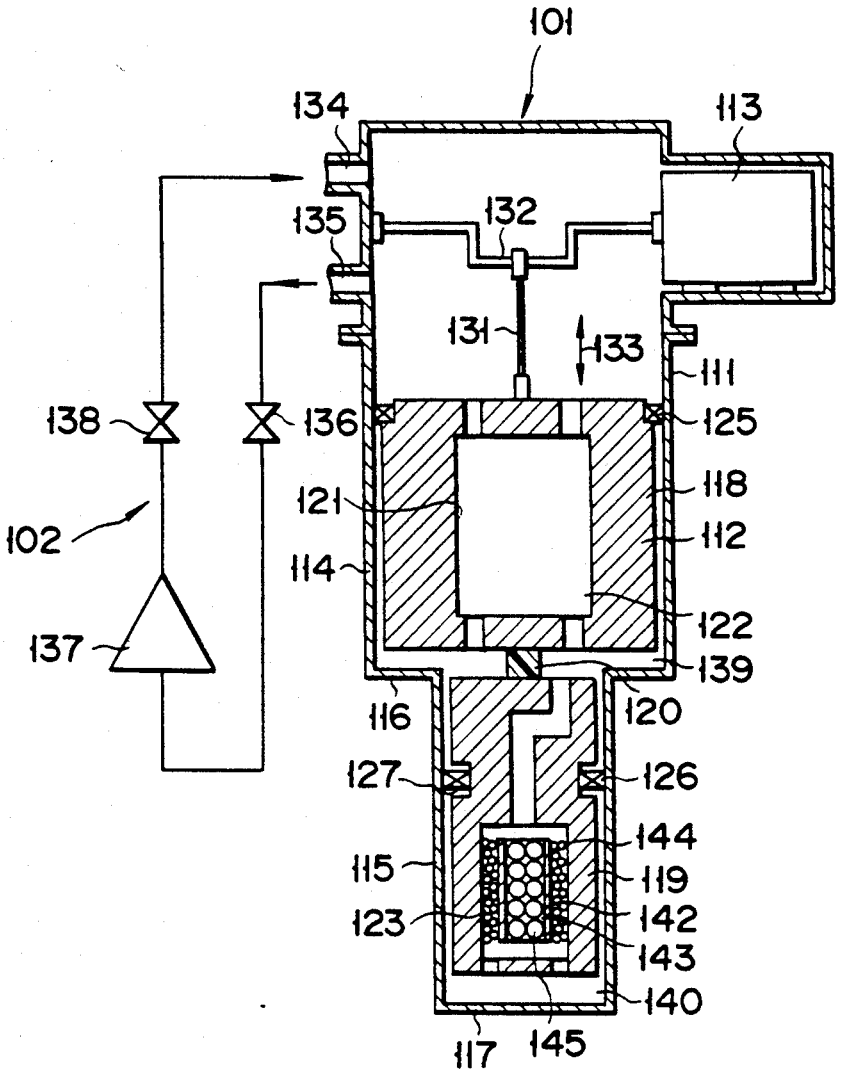
FIG. 8 is a cross sectional view showing a Gifford-McMahon type cryogenic refrigerator relating to one embodiment of the present invention.

FIG. 8 is a sectional view showing an example of the Gifford-McMahon type refrigerator, which is same in arrangement as the one shown in FIG. 1 except a fluid path or passage 123.

The refrigerator includes generally a cold head 101 and a coolant gas introducing and discharging system 102. The cold head 101 comprises a closed cylinder 111, a displacer 112 housed in the cylinder 111 and freely reciprocating therein, and a motor 113 for driving the displacer 112 to reciprocate in the cylinder 111.

The cylinder 111 includes a first large-diameter cylinder 114 and a second small-diameter cylinder 115 coaxially connected to the cylinder 114. The border wall between the first cylinder 114 and the second cylinder 115 forms a first stage 116 which serves as a cooling face, and the front wall of the cylinder 115 forms a second stage 117 which is lower in temperature than the first stage 116. The displacer 112 includes a first displacer 118 reciprocating in the first cylinder 114 and a second displacer 119 reciprocating in the second cylinder 115. The first and second displacers 118 and 119 are connected to each other by a connector member 120 in the axial direction of the cylinder 112. A fluid passage 121 is formed in the first displacer 118, extending in the axial direction of the displacer 118, and a cooling member 122 made by copper meshes or the like is contained in the fluid passage 121. Similarly, a fluid passage 123 is also formed in the second displacer 119, extending in the axial direction of the displacer 119, and a cooling member 124 made by copper balls or the like is contained in the fluid passage 123. Seal systems 125 and 126 are located between the outer circumference of the first displacer 118 and the inner circumference of the first cylinder 114 and between the outer circumference of the second displacer 119 and the inner circumference of the second cylinder 115, respectively.

The top of the first displacer 118 is connected to the rotating shaft of the motor 113 through a connector rod 131 and a Scotch yoke or crankshaft 132. When the shaft of the motor 113 is rotated, therefore, the displacer 112 is reciprocated as shown by an arrow 133 in FIG. 8, synchronized with the rotating shaft of the motor 113.

An inlet 134 and an outlet 135 for coolant gas extend outwards from the upper portion of one side of the first cylinder 114 and are connected to the coolant gas introducing and discharging system 102. This system 102 serves to circulate helium gas flowing through the cylinder 111 and includes a compressor 137 connected to the outlet 135 to the inlet 134 through a low-pressure valve 136 and a high-pressure valve 138. The system 102 also serves to compress low pressure helium gas (about 5 atm) to high pressure one (about 18 atm) through the compressor 137, sending the compressed helium into the cylinder 111. The low- and high-pressure valves 136 and 138 are opened and closed in a relation to the reciprocating displacer 112.

Figure 9:
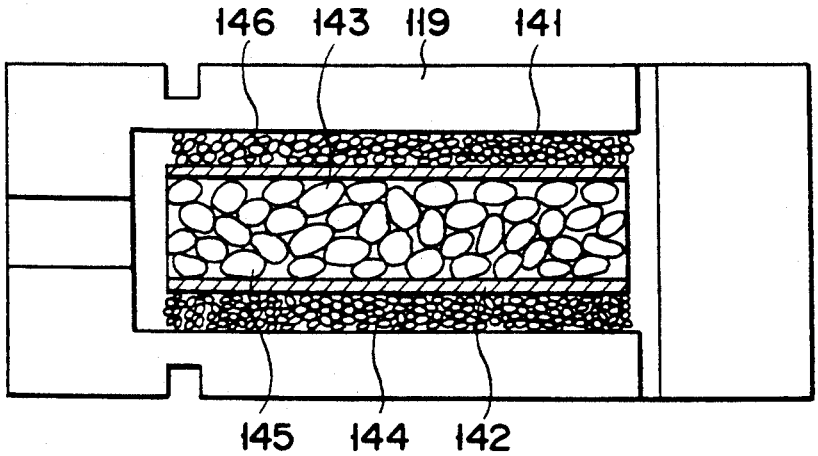
FIG. 9 is a cross sectional view showing a second displacer of the refrigerator of FIG. 8.

As shown in FIG. 9, a pipe 142 is coaxially housed in the fluid passage 123 and allows helium ga to flow inside and outside the pipe 142. A fluid passage 143 inside the pipe 142 is filled with a cooling member 145 shaped like balls each having a diameter of 0.4 mm and another fluid passage 144 outside the pipe 142 is filled with a cooling member 146 shaped like balls each having a diameter of 0.2 mm.

The passage of helium gas is divided into two in the same direction as helium gas flows, and the large-diameter cooling balls 145 are housed in the inner fluid passage 143. This reduces the pressure loss of helium gas flowing through the inner fluid passage 143 and the amount of helium gas flowing through the passage 143 is increased accordingly. The partial flow of helium gas can be thus reduced to a greater extent. This enables the cooling efficiencies of the cooling balls 145 and 146 to be increased so as to enhance the refrigerating capacity of the refrigerator.

Figure 2:
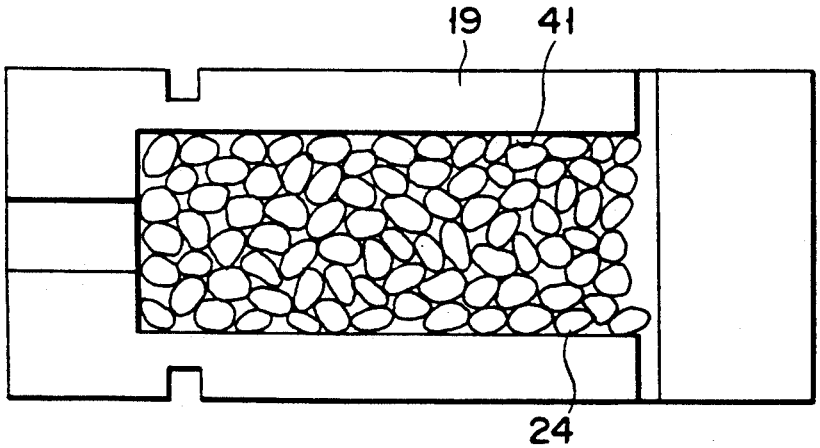
F I G. 2 (PRIOR ART)
FIG. 2 is a cross sectional view showing a second displacer of the refrigerator of FIG. 1.
Figure 3:
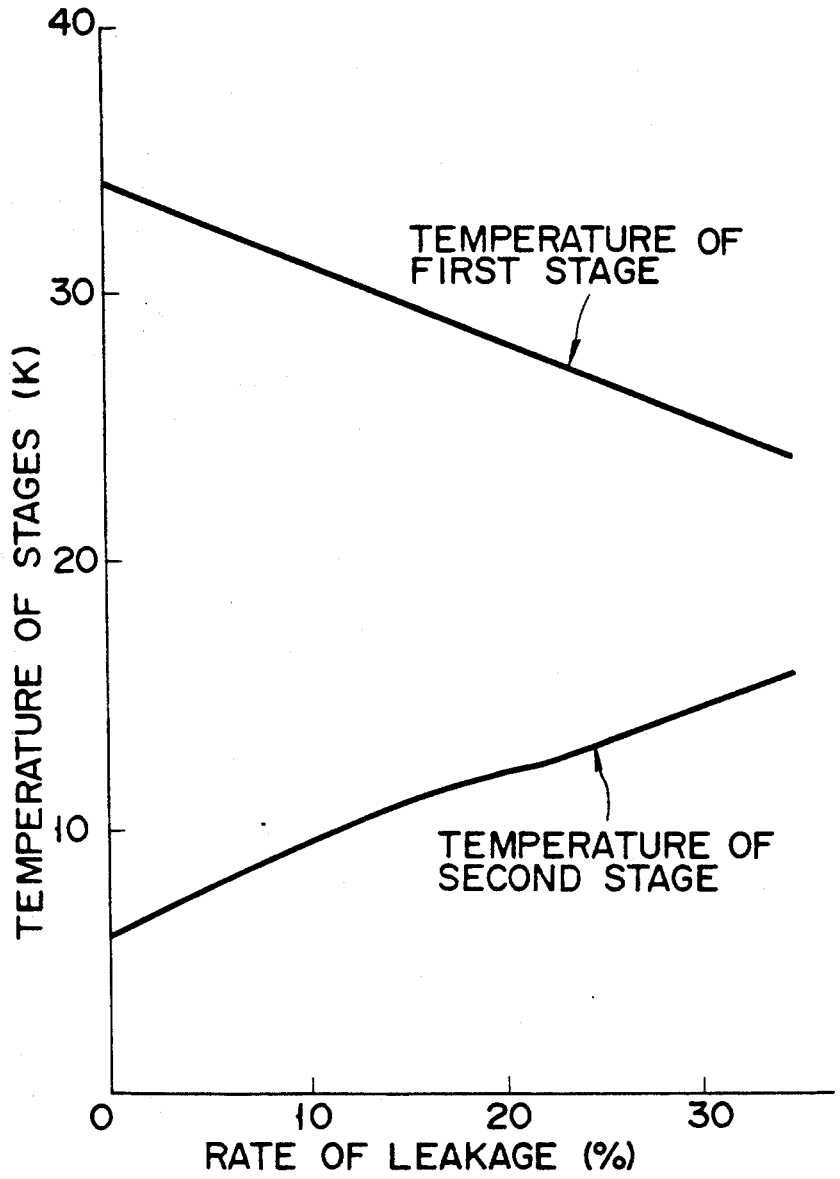
FIG. 3 (PRIOR ART)
FIG. 3 is a graph showing the relationship between a rate of leakage and temperature of stages in a sealing mechanism of the refrigerator of FIG. 1.
Figure 4:
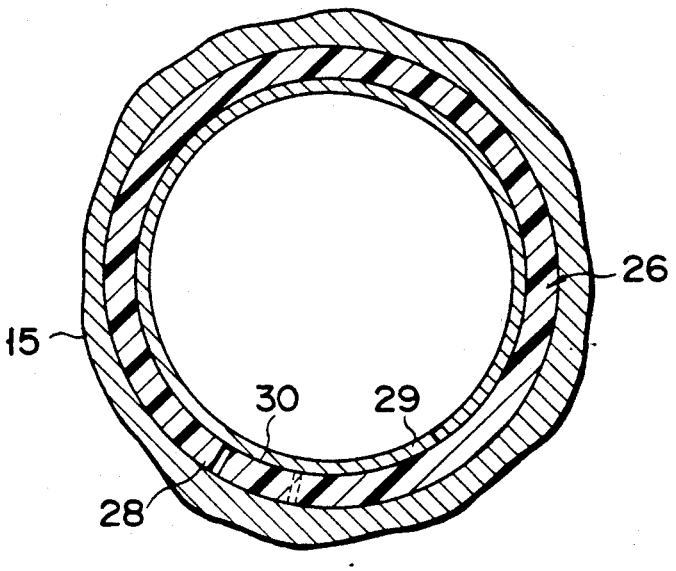
FIG. 4 (PRIOR ART)
FIGS. 4 to 6 are cross sectional views showing the sealing mechanism of the refrigerator of FIG. 1.
Figure 10:
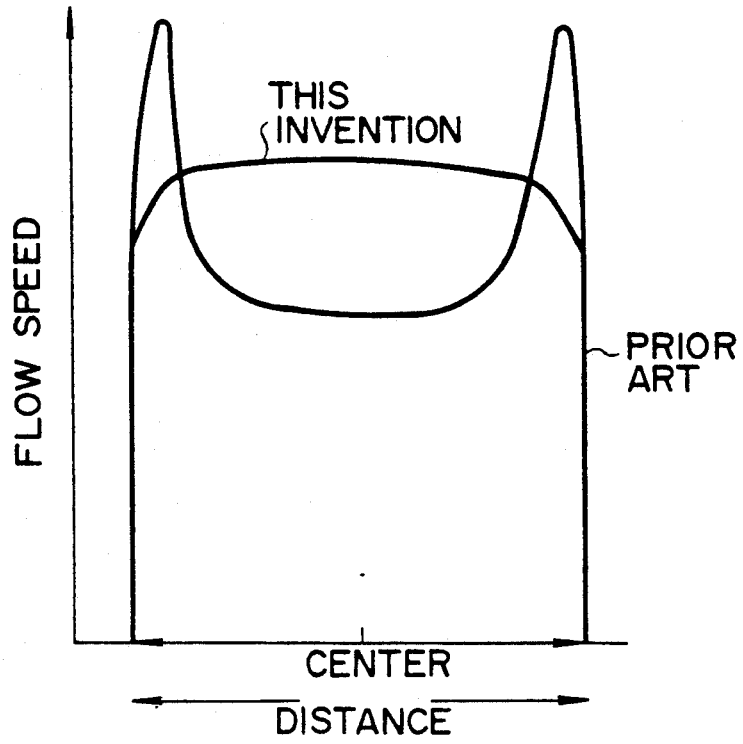
FIG. 10 is a graph showing the comparison between the speed distribution in helium gas in the cooling member of the second displacer of the refrigerator of FIG. 1 and that of the second displacer of the refrigerator of FIG. 8.
Figure 11:
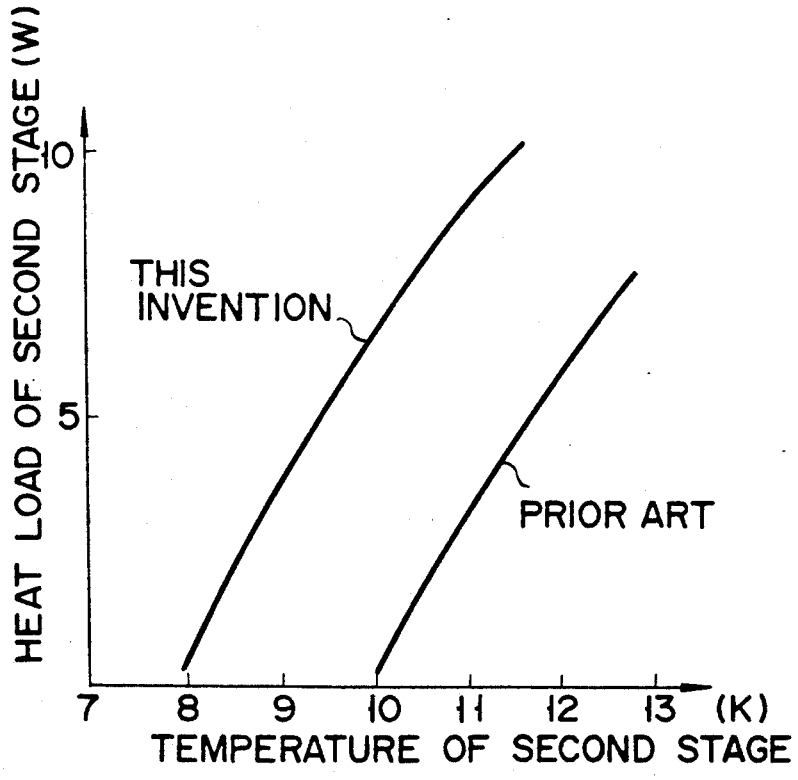
FIG. 11 is a graph showing the comparison between the cooling curve of the refrigerator of FIG. 1 and that of the refrigerator of FIG. 8.

FIG. 10 shows results obtained by measuring the flow speed distributions of helium gas flowing through the cooling members in the fluid passages shown in FIGS. 2 and 9. These results were obtained under normal temperature and with the refrigerators kept static, providing that the outer diameters of the fluid passages, the amounts of the cooling members contained in the fluid passages and the materials by which the cooling members are made are same. These conditions are different from those (cryogenic temperature and reciprocating motion) under which the refrigerators are practically operated, but it is understood that the flow speed distribution of helium gas flowing through the cooling member in the fluid passage shown in FIG. 9 is more uniform. It is supposed that this trend can be kept under the practical conditions. FIG. 11 shows refrigerating curves achieved by the conventional cryogenic refrigerator in which the fluid passage 23 shown in FIG. 2 is incorporated and by the cryogenic refrigerator of the present invention in which the fluid passage 123 shown in FIG. 9 is incorporated. The horizontal axis of the coordinate shown in FIG. 11 represents temperatures (K.) of the second stage 117 and the vertical axis thereof heat loads (W) added to the second stage 117. As apparent from FIG. 11, refrigerating capacity under same temperature is higher in the case of the cryogenic refrigerator according to the present invention. It is therefore understood that refrigerating capacity can be increased when the fluid passage 123 which has the above-described arrangement is employed. Although the fluid passage in this example is divided into two concentric ones, it may be divided into three or more ones. The diameter of the ball is not limited to 0.4 mm or 0.2 mm.

Figure 12:
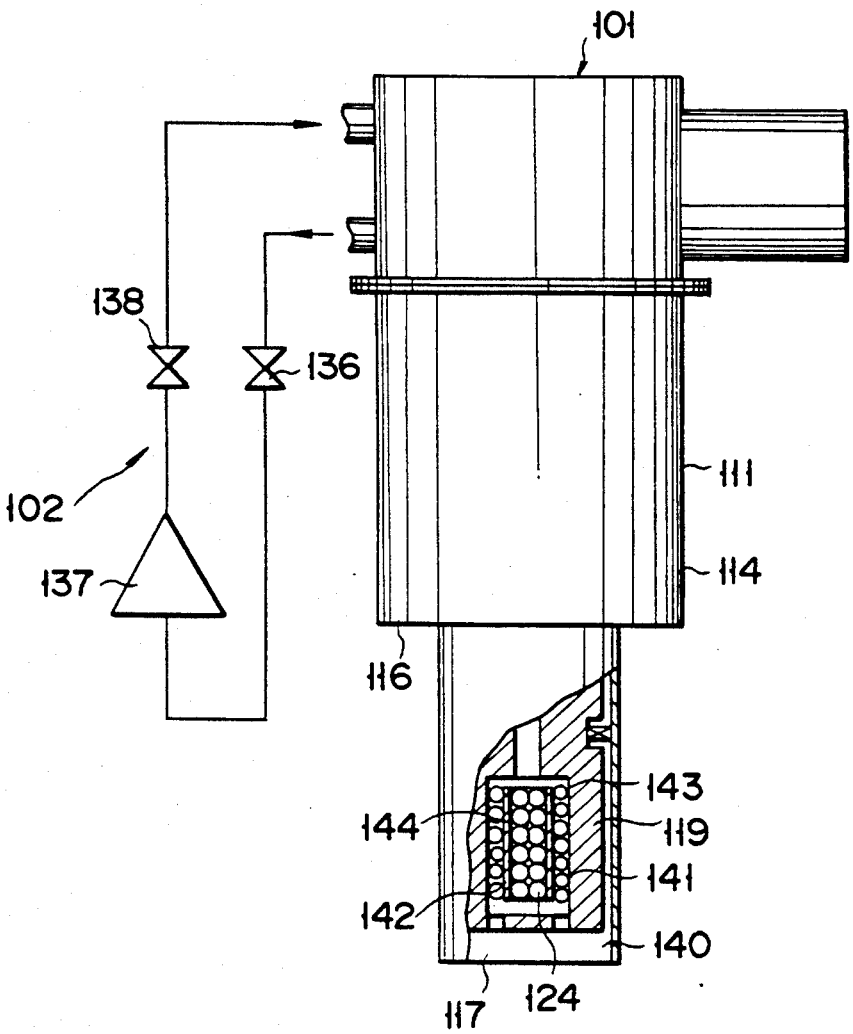
FIG. 12 is a cross sectional view showing a Gifford-McMahon type cryogenic refrigerator relating to a second embodiment of the present invention.
Figure 13:
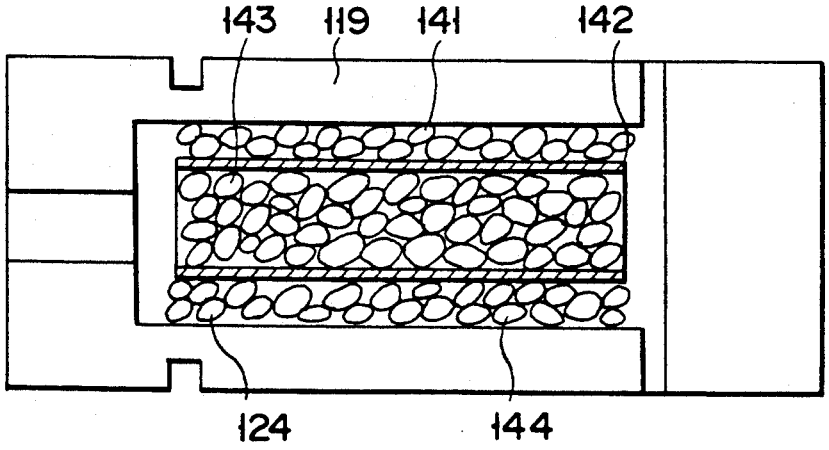
FIG. 13 is a sectional view showing a second displacer of the refrigerator of FIG. 12.

FIGS. 12 and 13 show a second example of the cryogenic refrigerator according to the present invention, in which the pipe 142 is coaxially housed in the fluid passage 141, the passage of helium gas is divided to flow inside and outside the pipe 142, and a cooling member 124 contained in the inner and outer passages 143 and 144 is shaped like balls each having same size. The passage of helium gas is divided into two in same direction as helium gas flows, so that the partial flow of helium gas can be reduced to a greater extent, as compared with that in the conventional case. Therefore, cooling efficiency achieved by the cooling member 124 can be increased to thereby enhance the refrigerating capacity of the refrigerator.

Figure 14:
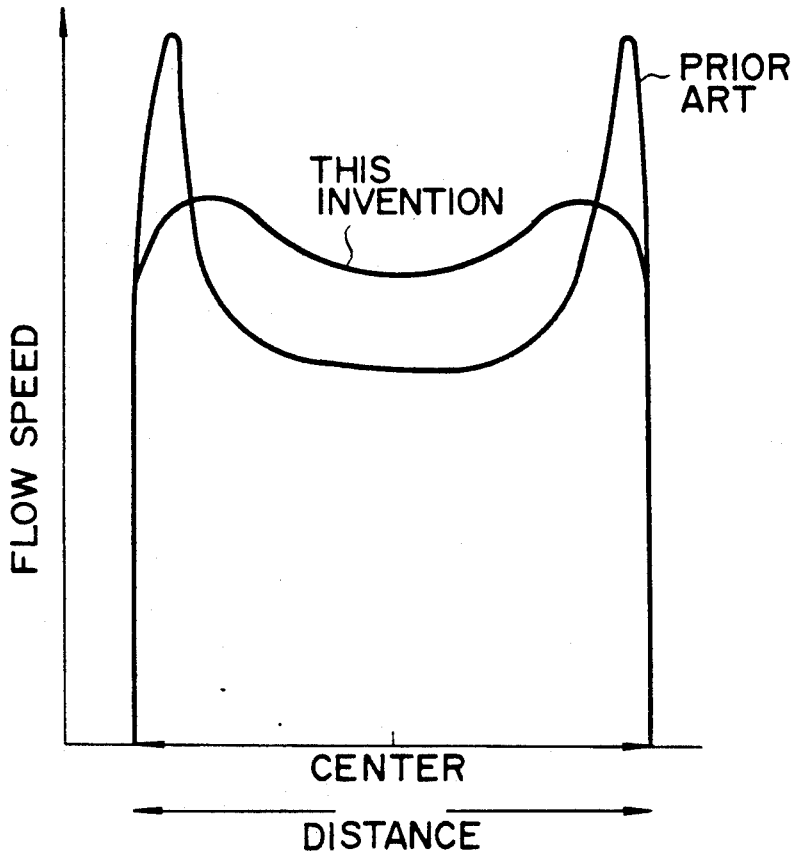
FIG. 14 is a graph showing the comparison between the speed distribution in helium gas in the cooling member of the second displacer of the refrigerator of FIG. 1 and that of the second displacer of the refrigerator of FIG. 12.

FIG. 14 shows results obtained by measuring the flow speed distributions of helium gas flowing through the cooling members contained in the fluid passages shown in FIGS. 2 and 13. These results were obtained under normal temperature and with the refrigerators kept static, providing that the outer diameters of the fluid passages, the amounts, shapes and sizes of the cooling members contained in the fluid passages, and the materials by which the cooling members are made are the same. These conditions are different from those (cryogenic temperature and reciprocating motion) under which the refrigerators are practically operated but it is understood that the flow speed distribution of helium gas flowing through the cooling member in the fluid passage shown in FIG. 13 is more uniform. It is supposed that this trend can be kept under the practical conditions. Although the fluid passage in this example is divided into two concentric ones, it may be divided into three or more ones. They may be neither concentric nor cylindrical.

FIG. 15 shows a third example of the cryogenic refrigerator according to the present invention.

This third example is different from the first example in the arrangement of a fluid passage 141 which is formed in the second displacer 119 and in which the cooling member 124 is contained.

As shown in FIG. 16, the cooling member 124 shaped like balls, and sheets of meshes 147 are contained in the fluid passage 141 in such a way that they are alternately piled in the fluid passage 141 in direction perpendicular to the flow of helium gas.

When the fluid passage 141 is arranged in this manner, helium gas flowing through the passage 141 can be made uniform by the sheets of meshes. The partial flow of helium gas can be thus reduced to a greater extent, as compared with that in the conventional case. Therefore, cooling efficiency achieved by the cooling member 124 can be increased so as to enhance the refrigerating capacity of the refrigerator.

FIG. 17 shows results obtained by measuring the flow speed distributions of helium gas flowing through the cooling members in the fluid passages shown in FIGS. 2 and 16. These results were measured under normal temperature and with the refrigerators kept static, providing that the outer diameters of the fluid passages, the amounts, shapes and sizes of the cooling members and the materials by which the cooling members are made are same. These conditions are different from those (cryogenic temperature and reciprocating motion) under which the refrigerators are practically operated, but it is understood that the flow speed distribution of helium gas flowing through the fluid passage shown in FIG. 16 is more uniform. It is supposed that this trend can be kept under the practical conditions. Glass wool or the like may be used as spacers instead of the sheets of meshes.

Although the fluid passage in the second displacer has been arranged as shown in FIGS. 9, 13 and 16 in the case of the above-described three examples, the fluid passage in the first displacer may be arranged as shown in FIGS. 9, 13 and 16. These arrangements of the fluid passage can be applied to the cryogenic refrigerator which includes third and fourth displacers. The fluid passage in which the cooling member is housed may be arranged as shown in FIGS. 9, 13 and 16 even in the case of those cryogenic refrigerators in which the displacers and the cooling accumulator are not combined as a unit.

FIG. 18 shows a fourth example of the cryogenic refrigerator according to the present invention. Same components as those in the first example shown in FIG. 8 will be represented by same reference numerals and description on these components will be omitted.

This example is different from the conventional cryogenic refrigerators by seal systems 151 and 155 which are fitted into ring-shaped grooves 127 and 128 on the outer circumference of the second displacer 119 to seal the clearance between the second displacer 119 and the second cylinder 115.

As shown in FIGS. 19 and 20, the seal system 151 includes an outer ring 152 having both ends, an inner ring 153 located on the backside of the outer ring 152, and a spring ring 154 coaxially located on the backside of the inner ring 153 to urge the ring 153 against the inner circumference of the second cylinder 115, these rings being fitted in the ring-shaped groove 127. The outer and inner rings 152 and 153 are made of resin. As shown in FIG. 20, the section of the inner ring 153 is shaped like a fallen L and the section of the outer ring 152 is a rectangle seated on the L-shaped section of the inner ring 153. The clearance between both ends of the outer ring 152 is shifted from that between both ends of the inner ring 153 by 180°. When both of the outer and inner rings 152 and 153 are combined with each other in this manner, the outer circumferences of the outer and inner rings 152 and 153 are contacted with the inner circumference of the second cylinder 115 while keeping two inner sides of the inner ring 153 contacted with two outer sides of the outer ring 152. As shown in FIG. 21, the sections of the outer and inner rings 152 and 153 in the seal system 151 are symmetrical with respect to the axis of the second cylinder 115 relative to those of the outer and inner rings 156 and 157 in the seal system 155. When the clearances in the seal system 151 are shifted from those in the seal system 155 in the circumferential direction of the second cylinder 115, therefore, helium gas can be prevented from leaking through these clearances. The leakage of helium gas can be thus reduced to a greater extent by these seal systems 151 and 155. The temperature of the second expansion chamber or second stage 117 can be prevented from rising to thereby enhance the refrigerating capacity of the refrigerator.

FIG. 22 shows results obtained by measuring the amounts of helium gas leaking through the conventional cryogenic refrigerator into which the seal system shown in FIG. 5 is incorporated and through the cryogenic GM refrigerator into which the seal systems 151 and 155 are incorporated. These results were measured under normal temperature and with the refrigerators kept static, providing that the widths of the ring-shaped grooves are made equal, that the shapes of the seal rings are same and that the materials by which the seal rings are made are same. These conditions are different from those (cryogenic temperature and reciprocating motion) under which the refrigerators are practically operated, but it is understood that the amount of helium gas leaked can be reduced to a considerable extent. It is supposed that this trend will be kept under practical conditions. FIG. 23 shows refrigerating curves achieved by the conventional cryogenic refrigerator into which the seal system shown in FIG. 5 is incorporated and by the cryogenic refrigerator of the present invention into which the seal systems 151 and 155 shown in FIG. 21 are incorporated. The horizontal axis of the coordinate shown in FIG. 23 represents temperatures (K.) of the second stage 117 and the vertical axis thereof denotes heat loads (W) added to the second stage 117. As apparent from FIG. 23, refrigerating capacity under same temperature is higher in the case of the cryogenic refrigerator according to the present invention. This teaches us that the refrigerating capacity can be increased when the seal systems 151 and 155 are employed.

Although the seal systems 151 and 155 have been arranged only between the second displacer and the second cylinder in the case of the above-described example, they may be arranged between the first displacer and the first cylinder.

FIG. 24 shows a fifth example of the cryogenic refrigerator according to the present invention. Same components as those in the example shown in FIG. 8 will be represented by same reference numerals and description on these components will be omitted.

When the first and second displacers 118 and 119 are to be filled with the cooling members 122 and 124 shaped like copper sheets of meshes and lead balls, a filler 167 is previously arranged along the inner walls of the first and second displacers 118 and 119 and the cooling members 122 and 124 are then housed inside the fillers 167 in the displacers 118 and 119. The filler 167 is cotton wool made of glass, metal, ceramic and other artificial inorganic fibers.

When clearances 148 between the inner wall of the first displacer 118 and the cooling member 122 and between the inner wall of the second displacer 119 and the cooling member 124 are filled with the fillers 167, the leakage of gas can be prevented to effectively carry out heat exchange between the cooling members 122 and 124 and the gas.

Sixth and seventh examples of the invention will be explained.

The refrigerators according to these embodiments are distinguished from the conventional one by a magnetic material used as the cooling member 124 contained in the displacer 119. The magnetic material contains a rare earth metal, such as La, Ce, Pr, Nd, Eu, Sm, Gd, Tb, Dy, Ho, Er, Tm, Yb, and Y, and is generally friable. The magnetic material may include $Er_3Ni$, GdRh, $RNi_2$ (R: Dy, Ho, Er), $A_{1-x}B_xRh_{i-y}x_y$ (A: Sm, Tb, Dy; B: Ho, Er, Tm, Yb; X: Cu, Zn, Ru, Pd, Ag, Re, Os, Ir, Pt, Au; $0 \leqq x \leqq 1$, $0 \leqq y < 0.2$), or the like.

The magnetic material is obtained by melting a row material, then breaking a resultant lump, and selecting particles of e.g. 100–500 μm by use of a screen. FIG. 25 shows the magnetic material thus obtained. As is shown in FIG. 25, the magnetic material M has a number of small edges 171 each having a height of several μm—several tens of μm and an angle of 30° or less. If the magnetic material is used as the cooling member, edges thereof may be broken into fine particles during a long time period of operation, thereby causing the fine particles to leak from the cooling accumulator into the refrigerator. The amount of the magnetic material lost will reach 2–3 weight %.

Two method can solve the problem, ,one being plating the magnetic particles, thereby coating their edges with metal films, and the other being removing the edges by mixing.

First, the sixth example directed to the method for coating the edges of each magnetic particle with a metal film will be explained.

It is preferable that this metal is more excellent in toughness than the magnetic material M, that its thermal conductivity is substantially same as that of the magnetic material M and that it can be more easily processed to coat the grain of the magnetic material M. Gold, silver, copper, nickel, chrome, aluminum, lead and molybdenum, for example, can be used as the metal film S. An alloy of these metals may be used, too. The metal film S is formed according to the plating or depositing manner. It is preferable that the metal film S has a thickness of several μm to several tens of μm.

FIG. 26A shows a grain of the magnetic material M which is obtained after the plating process. As seen in FIG. 26B, the sharp edge or tip 171 of the grain is coated by the plating metal S and when these grains of the magnetic material M are used as the cooling member, fine powder of the magnetic material M can be prevented from dropping from the second displacer 119 and adhering to the seal systems and the like to lower the refrigerating capacity of the refrigerator. This is because the sharp edges or tips 171 of the grain are fixed and rounded by the metal film S and because the metal film S serves as a lubricating layer or cushion to prevent stress from being added to the edges or tips 171 of the grain. The sharp edges or tips 171 can be thus prevented from breaking off from the grain of the magnetic material M.

FIG. 27 shows refrigerating curves achieved by the cryogenic refrigerator in which grains obtained by grinding the magnetic material M were used as the cooling member, and by the one in which grains obtained by grinding the magnetic material M were plated and then used as the cooling member. These refrigerating curves were obtained after the lapse of 100 hours since the refrigerators were under operation. The horizontal axis of a graph shown in FIG. 27 denotes temperatures (K.) of the second stage 117 and the vertical axis thereof represents heat loads (W) added to the second stage 117. The refrigerating curves were overlapped with each other just after the refrigerators were started, but they showed a difference in the refrigerating capacities of the two refrigerators after the lapse of 100 hours. The refrigerator in which plated grains of the magnetic material M were used as the cooling member showed same refrigerating capacity as that just after the start of its operation. After the refrigerating curves were obtained, both of the refrigerators were dismantled and examined. Fine powder of the magnetic material M adhered to the seal 126 in the case of the refrigerator in which grains of the magnetic material M obtained by grinding the material M were used as the cooling member, but no fine powder could be found in the case of the refrigerator in which grains of the magnetic material M were plated and then used as the cooling member. It is therefore supposed that fine powder of the magnetic material M which adhered to the seal causes the amount of gas leaked through the seal 126 to be increased to thereby lower the refrigerating capacity of the refrigerator, as seen in FIG. 27. This makes it apparent that the use of plated grains of the magnetic material M as the cooling member is more effective.

Next, the seventh example directed to the method for mixing magnetic particles will be explained.

As is mentioned above, the magnetic material M has a plurality of edges 171 each having a height of several μm to several tens of μm and an angle of 30° or less. If the magnetic material is used as the cooling member, edges thereof may be broken into fine particles during a long time period of operation, thereby causing the fine particles to leak from the cooling accumulator to the refrigerator. To avoid this, a magnetic material having no edges 171 of an angle 30° or less is used as the cooling member.

Such appropriate magnetic material can be obtained by melting a row material, breaking a resultant lump, selecting bodies of an appropriate size, and mixing them in an organic solvent containing no water or in an atmosphere containing no oxygen, nitrogen, or hydrogen. The reason why an organic solvent without water is used is that it is necessary to remove heat caused during mixing.

Further, the reason why the mixing is performed in an organic solvent containing no water or in an atmosphere containing no oxygen, nitrogen, or hydrogen is that the magnetic material containing a rare earth metal may deteriorate in a solvent containing water or in the atmosphere of oxygen, nitrogen, or hydrogen, thereby not only losing a function as the cooling member, but also causing fine particles which may choke a pipe or the like. Preferably, acetone or alcohol is used as the organic solvent. The alcohol is selected from the group consisting of methyl alcohol, ethyl alcohol, propyl alcohol, and buchyl alcohol.

In the case of using an organic solvent, the magnetic material and solvent are preferably in the ratio from 1:1 to 10:1. In the case of using a gas as a mixing atmosphere, the gas is preferably an inactive gas such as argon. In both cases, mixing can be performed at a room temperature. It is desirable to perform mixing by use of a ball mill without balls or a vibrating mill without balls. It is most desirable to use a planetary ball mill.

24-hour mixing was conducted using a planetary ball mill (Pulverisette III), 200 g of $Er_{0.5}Dy_{0.5}Ni_2$ as the magnetic material, and 100 g of acetone as the organic solvent.

FIG. 28 shows a grain of the magnetic material M obtained after the mixing process. As seen in FIG. 28, sharp edges or tips are removed from the grain by the mixing process. When these grains of the magnetic material M are used as the cooling member, it can be prevented that the sharp edges or tips are broken off from the grains of the magnetic material M and dropped, as fine powder, from the second displacer 119 into the refrigerator, while the refrigerator is being operated, to adhere to the seal and the like and lower the refrigerating capacity of the refrigerator.

Same refrigerating capacity test as that in the sixth example was conducted using the grains of the magnetic material M as the cooling member. Same results as those shown in FIG. 27 were obtained. Further, the refrigerators were dismantled and examined after the test and similar results as found in the sixth example were discovered.

Although description has been made about those refrigerators in which the displacer and the cooling accumulator are combined with each other as a unit, the present invention can be applied to the other refrigerators in which the displacer and the cooling accumulator are not combined as a unit.

Further, description has been made about the refrigerator of the Gifford-McMahon type which is typical of the cryogenic refrigerators, but the present invention can be applied to the other cryogenic refrigerators of the improved Solvay, Stirling and cycle types.

Still further, the magnetic material may be shaped like grains, powder and fabrics (such as the sheet of meshes). It may also be made porous.

The magnetic material may include $Er_3Ni$, $ErNi_2$, GdRh or the like.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

What is claimed is:

1. A method of making refrigerant particles for use with a cryogenic refrigerator which includes: a closed cylinder provided with an inlet and an outlet for introducing and discharging a coolant gas into and out of the closed cylinder, a dispenser slidably arranged in the closed cylinder and having a passage through which the coolant gas flows, a reciprocator for reciprocating the dispenser, and a device for repeating the process of introducing the coolant gas into the closed cylinder through the inlet and discharging the coolant gas out of the closed cylinder through the outlet in a relation to the reciprocating dispenser, said method comprising the steps of:

grinding a magnetic material comprising a rare earth metal;

screening grains of the ground magnetic material; and smoothing surfaces of the screened grains by mixing the screened grains using a ball mill without balls to remove sharp edges and tips from the screened grains.

2. The method according to claim 1, wherein the mixing is carried out in one of an organic solvent and gas, which is inactive with respect to the magnetic material.

3. The method according to claim 2, wherein the gas is an inert gas.

4. The method according to claim 3, wherein the inert gas is argon.

5. The method according to claim 2, comprising using one of acetone and alcohol as said organic solvent.

6. The method according to claim 2, wherein a ratio of the magnetic material to the organic solvent is 1:1 to 1:1:10.

7. The method according to claim 1, wherein said smoothing step comprises removing sharp edges and tips from said screened grains having an angle less than 30° with respect to said screened grains.

8. A method of making refrigerant particles for use with a cryogenic refrigerator which includes: a closed cylinder provided with an inlet and an outlet for introducing and discharging a coolant gas into and out of the closed cylinder, a dispenser slidably arranged in the closed cylinder and having a passage through which the coolant gas flows, a reciprocator for reciprocating the dispenser, and a device for repeating the process of introducing the coolant gas into the closed cylinder through the inlet and discharging the coolant gas out of the closed cylinder through the outlet in a relation to the reciprocating dispenser, said method comprising the steps of:

grinding a magnetic material comprising a rare earth metal;

screening grains of the ground magnetic material; and smoothing surfaces of the screened grains by coating the screened grains with a metal film.

9. The method according to claim 8, wherein the step of smoothing comprises coating the screened grains with a metal having a greater hardness than that of the magnetic material.

10. The method according to claim 8, wherein the step of smoothing comprises coating the screened grains with a metal film having a heat conductivity substantially the same as that of the magnetic material.

11. The method according to claim 8, wherein the step of smoothing comprises coating said screened grains with a metal selected from the group consisting of Au, Ag, Cu, Ni, Cr, Al, Pb, Mo and an alloy thereof.

* * * * *